United States Patent [19]

Altmann et al.

[11] Patent Number: 4,825,048

[45] Date of Patent: Apr. 25, 1989

[54] SEAT HEATER FOR INTEGRATED ASSEMBLY INTO CAR SEATS

[75] Inventors: Horst-Dieter Altmann, Gründau-Lieblos; Eberhard Haupt, Gründau-Rothenbergen, both of Fed. Rep. of Germany

[73] Assignee: I.G. Bauerhin GmbH elektro-technische Fabrik, Gruendau-Rothenbergen, Fed. Rep. of Germany

[21] Appl. No.: 163,312

[22] Filed: Mar. 2, 1988

[30] Foreign Application Priority Data

Aug. 4, 1987 [DE] Fed. Rep. of Germany ..... 3725841

[51] Int. Cl.[4] ..... H05B 3/36

[52] U.S. Cl. ..... 219/528; 219/202; 219/217

[58] Field of Search ..... 219/528, 529, 549, 217, 219/202, 211, 543, 345, 213

[56] References Cited

U.S. PATENT DOCUMENTS

| | | | |
|---|---|---|---|
| 729,222 | 5/1903 | Rickards | 219/541 |
| 1,691,472 | 11/1928 | Graham | 219/211 |
| 2,712,592 | 7/1955 | Goldstein | 219/528 |
| 3,013,141 | 12/1961 | Ellis | 219/202 |
| 3,017,493 | 1/1962 | Cooke | 219/217 |
| 3,858,028 | 12/1974 | Kerr | 219/211 |
| 4,590,359 | 5/1986 | Möbius | 219/217 |
| 4,628,188 | 12/1986 | Andreasson | 219/217 |
| 4,633,061 | 12/1986 | Arikawa | 219/202 |

FOREIGN PATENT DOCUMENTS

| | | |
|---|---|---|
| 8137914 | 9/1982 | Fed. Rep. of Germany . |
| 3544499 | 8/1987 | Fed. Rep. of Germany . |

*Primary Examiner*—Teresa J. Walberg
*Attorney, Agent, or Firm*—Gilbert L. Wells

[57] ABSTRACT

A seat heater for integrated assembly into car seats has at least two or several segments and faces, respectively, of any desired shaping. The heater includes several flat, electrically interconnected resilient heating elements (1.1/1.2) either forming a coherent heating face (1) or conforming to the section-wise individual seat configuration, especially the shaping thereof, with the connection between the individual heating elements (1.1/1.2) being respectively established by a low-strength electrical conductor (3) and the electrical conductor (3) being guided in an insulating resilient sheathing (6) of silicone rubber or the like engaging, at both ends, in partial lengths, each of the heating elements (1.1/1.2 et seq).

4 Claims, 1 Drawing Sheet

SEAT HEATER FOR INTEGRATED ASSEMBLY INTO CAR SEATS

BACKGROUND OF THE INVENTION

The present invention is concerned with a seat heater for integrated assembly into car seats, comprising at least two or more segments and faces, respectively, of any desired shaping.

The transitory area between the individual sections of the segments of a seat heater for automotive vehicles, which are created by means for fixing the seat covering cloth, constitutes the part of the heater which is most exposed to danger caused by a break of wire.

According to German Patent Application No. 35 44 499.1, in the area of transition in which is guided a part of the heater, the heater conduit is mechanically protected by a woven copper hose thereby, at the same time, precluding an accumulation of heat as the heat, through the copper, is dissipated into the heating plane.

According to German Petty Pat. No. 81 37 914 a wire break and a heat dissipation are precluded in that the transitory area is formed by a multiple-wire copper cable of major strength.

Both conventional methods involve the disadvantage that they are not generally suitable for all cases of end-use application.

Reinforcement by a copper hose will require that the transition area is comprised at least of one band integral with the segments of the heater.

Frequently, it is not possible to establish such a broad connection.

The copper cable which according to German Petty Pat. No. 81 37 914 forms the transitory area between the individual parts, requires that the heating wire as such is no longer continuous.

In the individual segments, points of connection are created between heating wire and copper cable which, in their turn, again constitute an endangered point and, in the event of a heater directly provided underneath the covering cloth, are marked on the surface.

SUMMARY OF THE INVENTION

It is the object of the invention to overcome the aforedescribed defects and risks and especially offer a solution to the problem of providing a soft transitory area between the individual heating elements.

The solution to this problem, according to the invention, provides that the seat heater is comprised of several flat, electrically interconnected resilient heating elements either forming a coherent heating face or conforming to the section-wise individual seat configuration, in particular the shaping thereof, and that the connection between the individual heating elements is respectively formed by a low-strength electrical conductor, and the electrical conductor is guided within an insulating resilient sheathing of silicone rubber or the like, and engages, at both ends, in sectional lengths, each of the heating elements.

BRIEF DESCRIPTION OF THE DRAWING

The enclosed drawing exhibits a solution by way of example.

In the drawings.

DESCRIPTION OF THE PREFERRED EMBODIMENT

Figure 2:
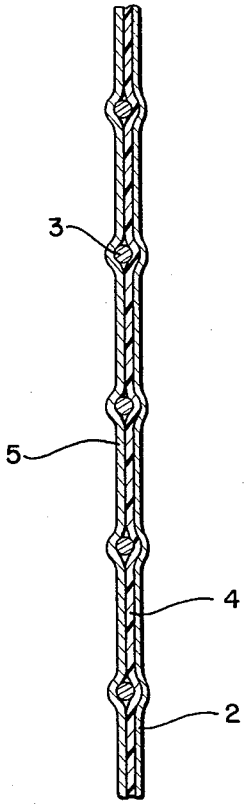
FIG. 2 shows a section along I—I of FIG. 1.
Figure 1:
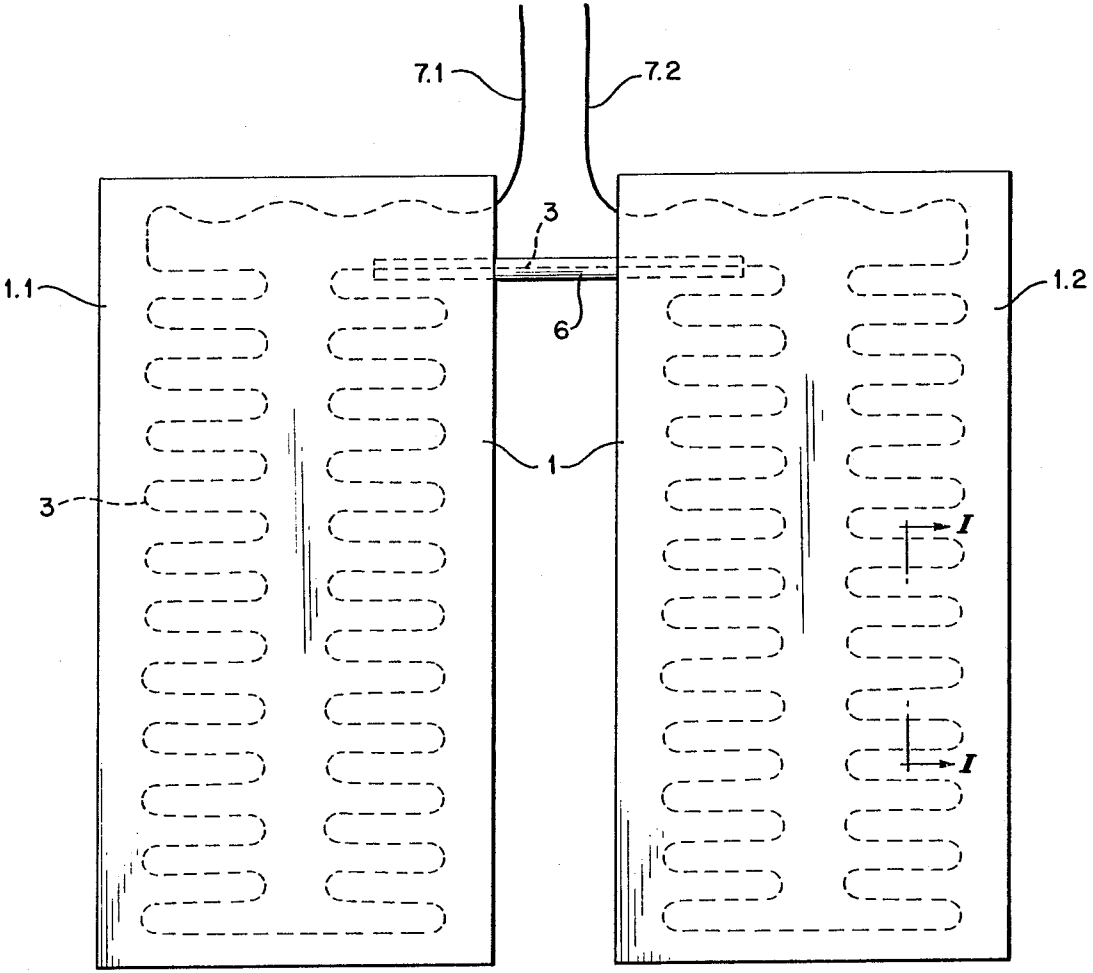
FIG. 1 shows the connection between two heating elements.

The current supply 7.1 to the heating element 1.1 is effected through conductor 3 thereof via the soft sheathing 6 engaging, with the two ends thereof, the heating elements 1.1 and 1.2, and through the connection of the conductor 3 in series to the heating element 1.2 such that a coherent heating face 1 is formed.

The heating face 1 is mounted on a removable supporting foil 2 connected to which is a layer 4 provided with an adhesive on the side facing the supporting foil 2, which layer 4, pointing to the opposite direction, fully accommodates an electrical conductor 3 formed by the opposite side of the layer 4 comprising a high-plastic basis.

The additionally provided layer 5 is a covering layer having no adhesive on the outer side; the supporting foil 2 is removed immediately prior to assembly, and the layer 4 is fixed, to the inner side of the covering cloth.

The layer 5 covers the internal side, i.e. the upholstery element and is movable vis-a-vis the latter.

We claim:

1. In a seat heater for integrated assembly into car seats, comprising at least two segments, the improvement comprising:

said heater including a resilient heating element in each of said segments, said heating elements being interconnected in series and defining a plurality of coherent heaters, a connection between each said heating element in each of said segments comprising a low strength electrical conductor, said electrical conductor being guided within an insulating resilient sheathing of silicone rubber.

2. The seat heater of claim 1, wherein said heater comprises a plastic layer accommodating said heating element with an adhesive on one side of said layer and a covering layer on another side of said plastic layer.

3. In a seat heater for integrated assembly into car seats, comprising at least two faces, the improvement comprising:

said heater including a flat, resilient heating element in each of said faces, said heating elements being interconnected in series and defining a plurality of coherent heaters, a connection between each said heating element in each of said faces comprising a low strength electrical conductor, said electrical conductor being guided within an insulating resilient sheathing of silicone rubber.

4. The seat heater of claim 3, wherein said heater comprises a plastic layer accommodating said heating element with an adhesive on one side of said layer and a covering layer on another side of said plastic layer.

* * * * *